US006641452B2

(12) United States Patent
Racine

(10) Patent No.: US 6,641,452 B2
(45) Date of Patent: Nov. 4, 2003

(54) BUILDING BLOCK

(76) Inventor: Susan J. Racine, 1651 W. Fifth St., Mesa, AZ (US) 85201

( * ) Notice: Subject to any disclaimer, the term of this patent is extended or adjusted under 35 U.S.C. 154(b) by 69 days.

(21) Appl. No.: 09/947,311

(22) Filed: Sep. 5, 2001

(65) Prior Publication Data

US 2003/0060117 A1 Mar. 27, 2003

(51) Int. Cl.[7] ..... A63H 33/12; A63H 33/08
(52) U.S. Cl. ..... 446/122; 446/124
(58) Field of Search ..... 446/85, 86, 117, 446/120, 121, 124, 128, 122; 52/608, 604, 592.6

(56) References Cited

U.S. PATENT DOCUMENTS

| | | | | | |
|---|---|---|---|---|---|
| 1,250,971 | A | | 12/1917 | Converse | |
| 2,354,485 | A | * | 7/1944 | Slaughter | 446/87 |
| 2,649,803 | A | | 8/1953 | Andre | |
| 2,861,388 | A | | 11/1958 | Favaretto | |
| 2,910,737 | A | | 11/1959 | MacMillan | |
| 2,972,833 | A | | 2/1961 | La Grutta | |
| 3,192,738 | A | * | 7/1965 | Charles et al. | 446/121 |
| 3,220,141 | A | | 11/1965 | Goss, III | |
| 3,305,982 | A | | 2/1967 | Steele | |
| 3,368,316 | A | | 2/1968 | Crowder | |
| 3,374,917 | A | | 3/1968 | Troy | |
| 3,391,824 | A | * | 7/1968 | Wiseman | 446/125 |
| 3,554,236 | A | * | 1/1971 | Rhodes | 138/117 |
| 3,838,535 | A | | 10/1974 | Larws | |
| 4,060,952 | A | | 12/1977 | Hernandez | |
| 4,115,980 | A | | 9/1978 | Martel et al. | |
| 4,267,662 | A | | 5/1981 | Gordy | |
| 4,521,203 | A | | 6/1985 | Rothenberg, Jr. | |
| 4,823,532 | A | * | 4/1989 | Westerburgen | 52/592.6 |
| 4,824,112 | A | | 4/1989 | Roy | |
| 4,919,268 | A | * | 4/1990 | Young et al. | 206/509 |
| 4,922,678 | A | * | 5/1990 | Scheiwiller | 52/608 |
| 5,273,477 | A | | 12/1993 | Adams, Jr. | |
| 5,361,557 | A | * | 11/1994 | Snyder et al. | 52/608 |
| 5,471,808 | A | * | 12/1995 | De Pieri et al. | 52/603 |
| 5,832,687 | A | | 11/1998 | Willemsen | |
| 5,848,927 | A | | 12/1998 | Frederiksen | |
| 6,050,873 | A | | 4/2000 | Reisman | |
| 6,161,357 | A | | 12/2000 | Altemus | |
| 6,244,009 | B1 | * | 6/2001 | Cerrato | 52/604 |

* cited by examiner

*Primary Examiner*—Jacob K. Ackun
*Assistant Examiner*—Faye Francis
(74) *Attorney, Agent, or Firm*—Schmeiser, Olsen & Watts

(57) ABSTRACT

A building block and a method for building structures from the building blocks is disclosed herein. The building block has a male element, a female element, and a lock mechanism. A first block can be reversibly locked to a second block when a third block is inserted into the first block. The blocks can be sized for use as toys or for use in building temporary or permanent structures. In addition, the blocks can be sized and shaped to resemble boards or lumber for constructing temporary or permanent structures such as decks or fences and can be assembled without using nails or other reinforcing or connecting devices.

7 Claims, 6 Drawing Sheets

BUILDING BLOCK

BACKGROUND OF THE INVENTION

1. Technical Field

This invention relates to a building block, sized for use as a toy or sized to build usable structures, where a first building block can be reversibly locked into a second building block when a third building block is inserted into the first building block using a lock mechanism integral to the blocks.

2. Background of the Invention

Blocks have long been used as toys as well as building materials for construction. Structures made from toy blocks may be easy to build, but they may also be unstable and easy to knock down. Large structures built from these blocks may pose a significant danger to children and adults. Toy blocks with protuberances and receptacles for locking the blocks to each other have been developed. These blocks may be difficult to unlock from each other. These blocks may also be impractical for use in building usable structures such as sheds or play houses or other temporary or permanent structures.

Blocks designed to be used to build buildings often require mortar or other material to affix one block to another. When mortar is used, structures built with blocks are permanent structures which may require significant effort to disassemble. Such disassembled blocks are rarely reusable. Or, building blocks may use a separate external reinforcing element, such as nails, rebar, or other hardware to reinforce the stability of the block structure.

Therefore there exists a need for a toy block which can be reversibly locked in place to form a large stable structure, and easily unlocked and disassembled from a block construction. There is also a need for a building block which can be assembled into a solid temporary or permanent structure without the use of mortar or other external reinforcing devices, which can also be disassembled with minimal effort, and which can be reused.

SUMMARY OF THE INVENTION

A building block which has an integral reversible lock mechanism and a method for assembling multiple building blocks to build a structure is disclosed herein. The building block may be sized for use as a toy, or may be sized for use in building usable structures such as sheds, playhouses, dog houses or other temporary or permanent structures. The building block may be hollow or solid, and may be made of clear material for use as a window or other see-through elements of a structure. The building blocks may be assembled to form walls, and may be used to construct straight walls, curved walls, walls at angles in relation to each other, roof structures or other structures. In addition, the building blocks may be shaped and sized to build specific structures. For example, the building blocks may be shaped to resemble lumber to be assembled into a deck.

This invention provides a building block with a male element, a female element and a lock mechanism. A first block can be assembled in relation to a second block by inserting the male element of the first block into the female element of the second block. The lock mechanism may allow the first block to be locked to the second block when a third block is assembled in relation to the first block by inserting the male element of the third block into the female element of the first block. The lock mechanism may have a flange with a lock nub which can be inserted into a lock socket of an adjacent block. When the male element of a third block is inserted into the female element of the first block, the male element of the third block may press against the flange of the lock mechanism on the first block, forcing the lock nub of the first block into the lock socket of the second block, locking the first block to the second block. To release the lock and release the first block from the second block, the third block may be removed, releasing pressure against the flange and releasing the lock nub from the lock socket. Once the third block is removed from the first block, the first block is freely removable from the second block.

The foregoing and other features and advantages of the invention will be apparent from the following more particular description of preferred embodiments of the invention, as illustrated in the accompanying drawings.

BRIEF DESCRIPTION OF THE DRAWINGS

The embodiments of the present invention will hereinafter be described in conjunction with the appended drawings, wherein like designations denote like elements, and.

DETAILED DESCRIPTION OF THE EMBODIMENTS

Figure 1:
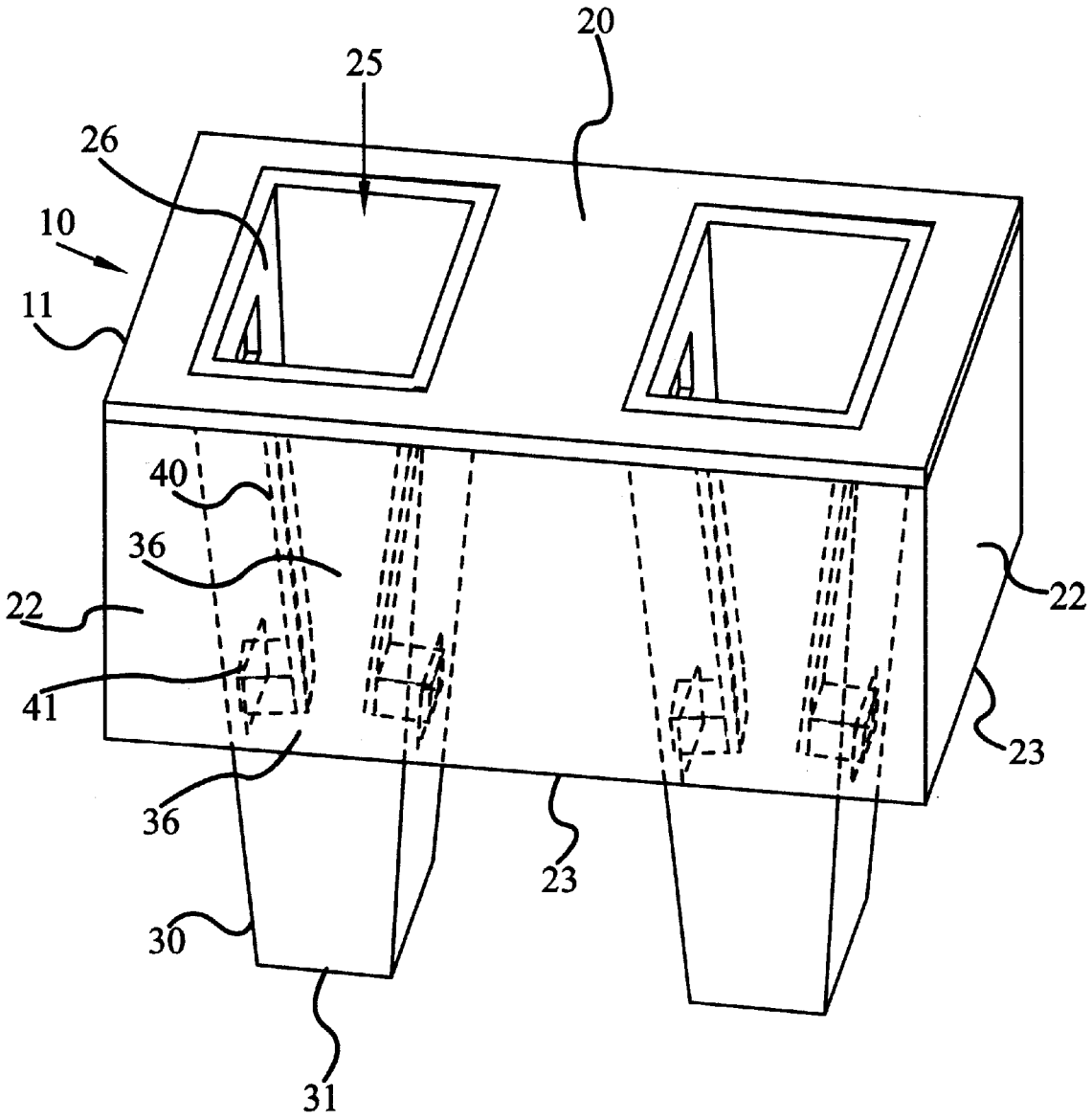
FIG. 1 is a perspective view of a building block of an embodiment of the present invention.

This invention provides a building block, sized for use as a toy or sized to build usable structures, where a first building block can be reversibly locked into a second building block when a third building block is inserted into the first building block using a lock mechanism integral to the blocks. FIG. 1 illustrates an embodiment of the building block 10. Building block 10 may be sized for use as a toy, or may be sized for use in building usable structures such as sheds, playhouses, dog houses, decks, fences, gazebos or other temporary or permanent structures. Building block 10 has a building block body 11 which may be hollow or solid, and may be made of clear material for use as a window or other see-through elements of a structure. Building block 10 may be constructed of heavy plastic, lucite, light-weight solid plastic, recycled plastic, or any other suitable material. Building block 10 may also be sized and shaped to resemble a board or lumber. Building block 10 can be used to build structures without using nails, mortar, rebar or other reinforcing elements. Building block 10 can also be used to build buildings using reinforcing elements such as nails, mortar, etc. Structures built from building blocks 10 can be disassembled, and building blocks 10 can be reused to build another structure. Structures built from these building blocks can also be weatherproof.

As illustrated in FIG. 1, building block 10 has a top surface 20, a bottom plane 21 (not shown), side walls 22 and male elements 30. FIG. 1 illustrates top surface 20 having two orifices, or female elements 25. While FIG. 1 illustrates two female elements 25, more or fewer female elements may be present, without deviating from the scope of the invention. Protruding from bottom plane 21 of building block 10, is male element 30. While two male elements 30 are illustrated, more or fewer male elements 30 may also be present without deviating from the scope of the invention. Building block 10 may be composed of solid material, such as plastic or other suitable material. If building block 10 is composed of solid material, bottom plane 21 is a surface interrupted by protruding male element(s) 30. If building block 10 is hollow, bottom plane 21 is an open area bounded on four sides by the bottom edges 23 of side walls 22, which define bottom plane 21, interrupted by protruding male element(s) 30. The tip 31 of male element 30 may be closed or open, and may be rounded to assist with the ease of assembly of the blocks.

Female element 25 has an interior surface 26. Interior surface 26 of female element 25 is continuous with an interior surface (not shown) of the tip 31 of male element 30. Also illustrated in FIG. 1 is lock flange 40 with a lock nub 41 protruding into the interior 36 of male element 30. Male element 30 may be rounded, conical, cylindrical, square-shaped, pyramidal, or any other shape.

Figure 2:
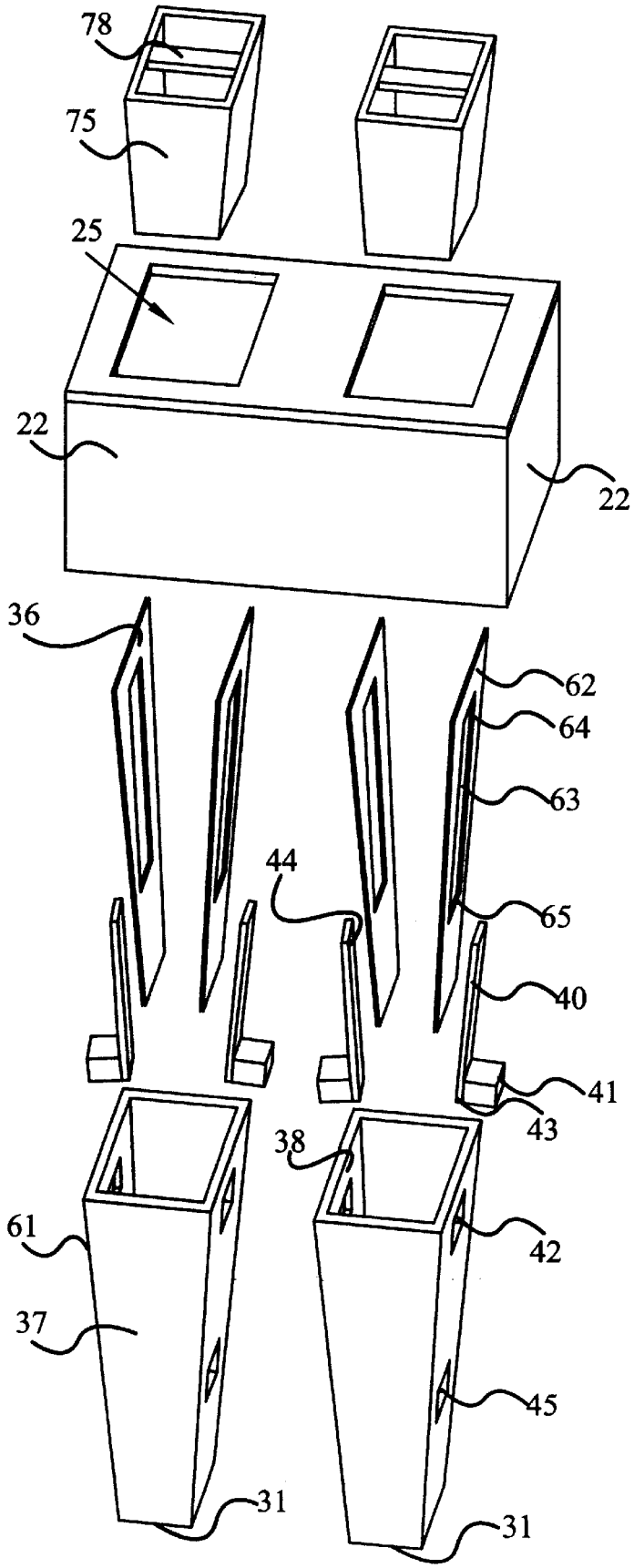
FIG. 2 is an exploded view of the assembly of an embodiment of the present invention.

FIG. 2 illustrates an embodiment of male element 30. FIG. 2 illustrates that male element 30 may be assembled of an outer shell 61 defining an exterior surface 37 of male element 30 and having an interior surface 38. Affixed to the interior surface 38 of outer shell 61 is an interior layer 62 of material which defines the interior surface 38 of male element 30. Interior layer 62 may have a cut-out 63 with an upper end 64 and a lower end 65. Cut-out 63 is sized to accommodate flange 40. A connector end 44 of flange 40 can be affixed to the interior surface 38 of outer shell 61 through cut-out 63 to allow lock nub end 43 of lock flange 40 to extend into the interior of male element 30. Lock flange 40 is comprised of plastic or other material which has some innate springiness or bendability. When lock flange 40 bends, lock nub end 43 of flange 40, with lock nub 41 attached, can fit through lower end 65 of cut-out 63, and pass through a corresponding lock nub hole 45 in outer shell 61. Upon the application of a bending force to lock flange 40, lock flange 40 bends, causing lock nub 41 to extend through lock nub hole 45. FIG. 2 also illustrates a lock socket 42.

Alternatively, male element 30 can be made from a single layer of material. Lock flange 40 can be attached to the interior surface 38 of male element 30 so that lock flange 40 extends into the interior of male element 30. Lock flange 40 can be attached to interior surface 38 of male element 30 by gluing, heat welding, or any other method. Or, lock flange 40 can be integral to male element 30, and can be made to extend into interior of male element 30 by cutting a flange strip from the male element 30 material and treating the strip to cause it to extend into the interior of male element 30. For example, if block is made from plastic, flange 40 can be cut out on three sides from the material of male element 30, heated and bent near its connector end 44 so that flange 40 extends into the interior of male element 30. Upon the application of a bending force to lock flange 40 by a third block, lock flange 40 could bend causing lock nub 41 to extend through lock nub hole 45.

Male element 30 can be attached to the inside surface (not shown) of top surface 27 so that male element 30 is aligned with female element 25 in top surface 20 of block 10 by gluing, heat welding, or any other attaching means. Alternatively, male element 30 can manufactured as an integral part of block 10.

Figure 3:
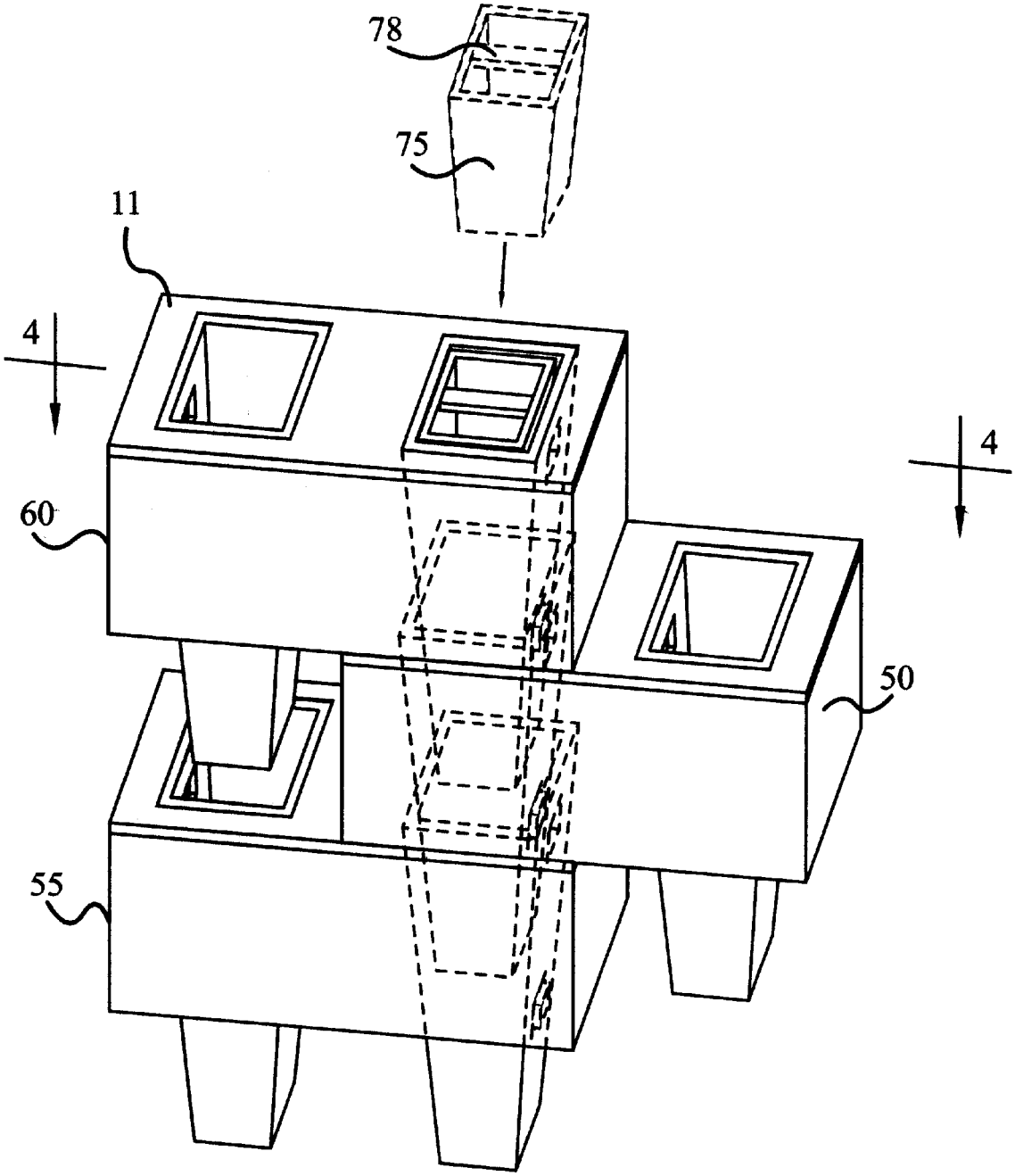
FIG. 3 is a perspective view of three blocks assembled together, according to an embodiment of the present invention.
Figure 4:
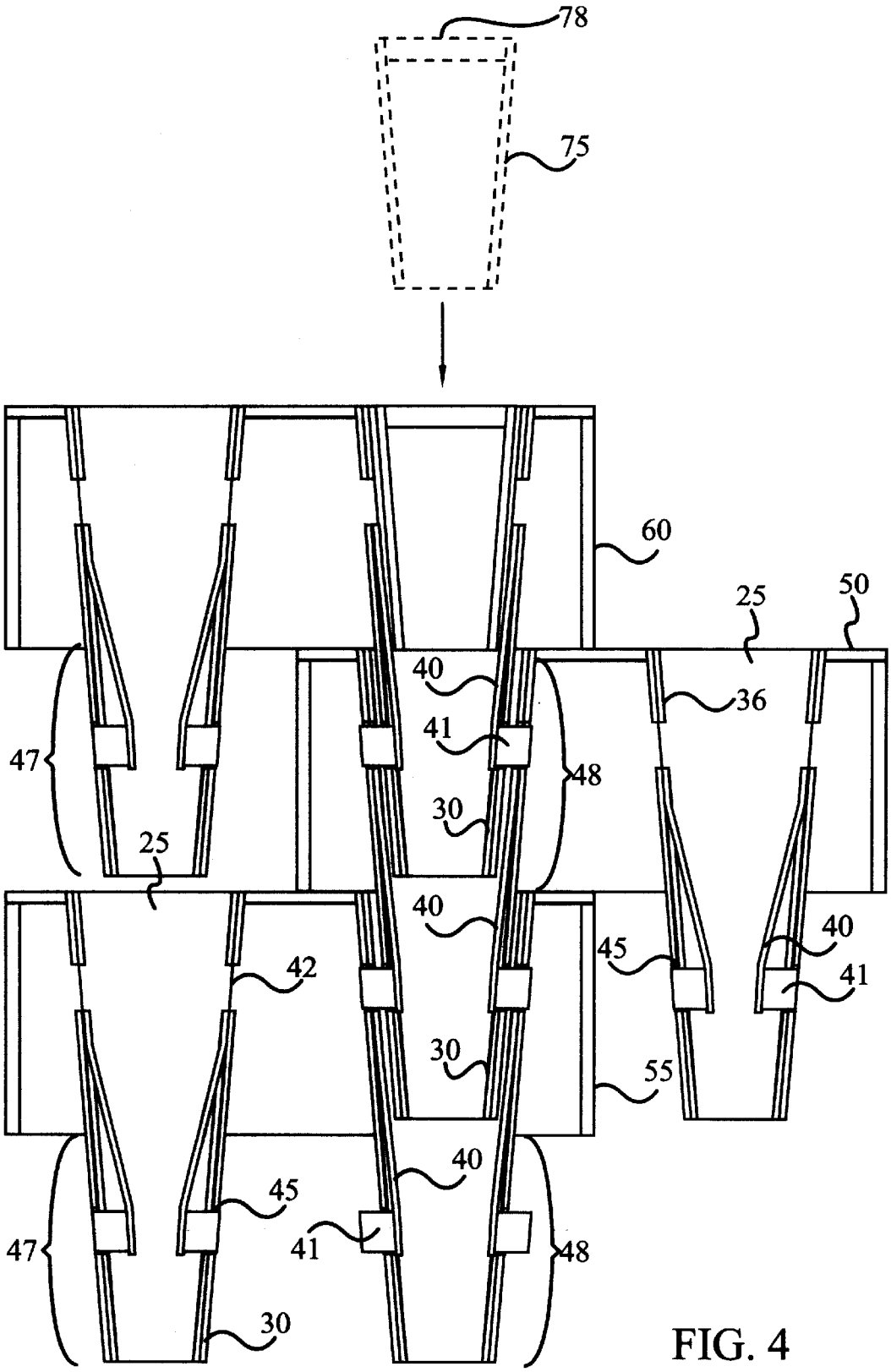
FIG. 4 is a cut-away view along line 4 of FIG. 3, of three blocks illustrating the lock mechanism in the unlocked position and the locked position in an embodiment of the present invention.

FIG. 3 is a perspective view of an embodiment of the invention showing three blocks, a first block 50, a second block 55 and a third block 60, the first block 50 stacked on top of the second block 55, and the third block 60 stacked on top of the first block 50. FIG. 4 is a cut-away view at line 4 in FIG. 3 of a first block 50, a second block 55 and a third block 60, illustrating an embodiment of the lock mechanism in an unlocked position 47 and a locked position 48. According to this embodiment, when first block 50 is stacked on top of second block 55, the male element 30 of the first block 50 is inserted into the female element 25 of the second block 55. When so engaged, the lock nub hole 45 of first block 50 is aligned with the lock socket 42 of second block 55 so that, when a bending force is applied to the lock flange 40 of the first block 50, the lock flange 40 bends, the lock nub 41 is forced through the lock nub hole 45 of the first block and through the lock socket 42 of the second block 55 to lock first block 50 to second block 55.

In the unlocked position 47, no bending force is applied to flange 40. In the absence of a bending force, flange 40 extends into the interior of male element 30. In the unlocked position, lock nub 41, attached to lock flange 40, is in the interior of male element 30 and is not extended through lock nub hole 45 of first block 50 or lock socket 42 of second block 55. Alternatively, lock mechanism may be any lock mechanism which allows blocks, assembled as illustrated in FIGS. 3 and 4, to reversibly lock together.

In one embodiment, depending upon the location of the lock flanges 40 of the first block 50 and the lock sockets 42 of the second block 55, the two blocks can be assembled at an angle in relation to each other. For example, if the lock sockets 42 and lock flanges 40 are aligned parallel to a center line through the long axis of the block, the two blocks will snap together to form a flat wall. If the lock sockets 42 and lock flanges 40 are aligned parallel to a center line through the short axis of the block, the two blocks may snap together to form a right angle or comer. The lock sockets 42 and lock flanges 40 can be aligned to form any angle between the blocks. In addition, the blocks may be rectangular, square or any shape and may incorporate curves, angles, or any other geometric feature. The blocks may be used to form any desired shape of wall or structure including curves, angles, or other geometric shape. In addition, if the block is formed as a solid block, the lock socket 42 may be a groove instead of a hole, and may allow the blocks to swivel in relation to each other as the flange of the first block 50 moves slidingly through the grooved lock socket of the second block 55. Or, a groove may define a range through which the blocks may swivel in relation to each other as the flange of the first block 50 moves slidingly through the grooved lock socket of the second block 55.

In the embodiment of the locked position 48, as illustrated in FIG. 4, a third block 60 is illustrated with the male element 30 inserted through the female element 25 of the first block 50. Male element 30 of third block 60 inserts slidingly into female element 25 of first block 50. When male element 30 of third block 60 inserts into female element 25 of first block 50, male element 30 of third block 60 applies a bending force to lock flange 40 of first block 50, causing lock flange 40 to bend toward the interior surface 36 of female element 25 of first block 50. Lock nub 41 is attached to lock flange 40. As lock flange 40 bends, lock nub 41 is pressed through lock nub hole 45 of first block 50 and through lock socket 42 of second block 55. When lock nub 41 of first block 50 is inserted through lock socket 42 of second block 55, first block 50 is locked in relation to second block 55.

To release the lock and release the first block 50 from the second block 55 in this embodiment, the third block 60 is removed, removing the bending force from the lock flange 40 of the first block, and releasing the lock nub 41 of the first block 50 from the lock socket 42 of the second block 55. Once the third block 60 is removed from the first block 50 and the lock flange 40 of the first block 50 is released from the lock socket 42 of the second block 55, the first block 50 is freely removable from the second block 55.

Figure 5:
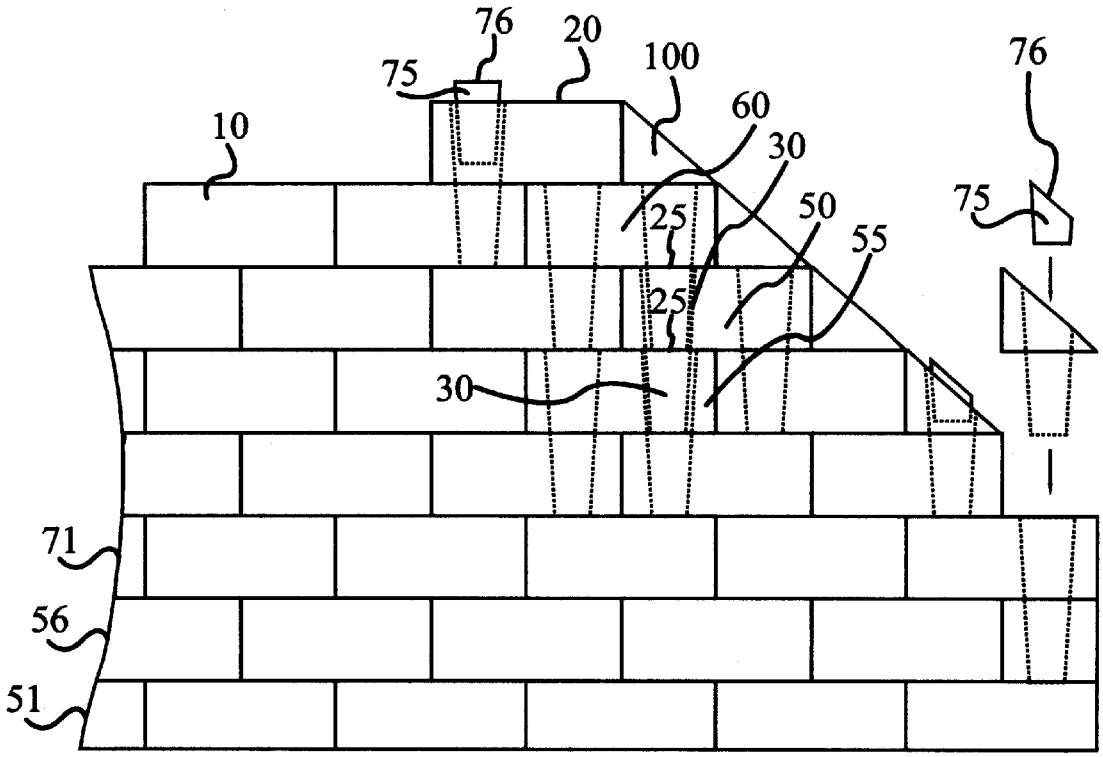
FIG. 5 is an illustration of an embodiment of a structure built using the building blocks.

FIG. 5 illustrates an embodiment of an assembly of multiple blocks 10. Individual building blocks 10 can be locked together as described by inserting the male element 30 of a first block 50 through a female element 25 of a second block 55, and inserting the male element 30 of a third block 60 through a female element 25 of first block 50 to cause lock nub 41 of first block 50 (See FIG. 4) to engage lock socket 42 of second block 55, thereby locking first block 50 to second block 55. An assembly of multiple blocks 10 can be constructed by placing a first row of blocks 51 in a desired location, placing a second row of blocks 56 on top of the first row 51, and locking the second row of blocks 56 to the first row of blocks 51 by placing a third row of blocks 71 into place on top of the second row of blocks 56.

In another embodiment, instead of a third block 60, a plug 75 may be inserted into the female element 25 of the first block 50 to lock the first block 50 to the second block 55. FIG. 5 illustrates that the plug 75 has a top surface 76. When the plug 75 is inserted into the female element 25 of a block 10 and pressed into place, the top surface of the plug 75 may lie flush with the top surface 20 of the block. To finish a wall or other structure, plug 75 may be inserted into the female elements 25 of the top blocks of the structure to create a finished, flush surface, and to lock the top row of blocks into place. Plug 75 may have finger holes (not shown) or handle 78 or other feature to assist with removing the plug 75 from the female element 25 of the building block 10. This feature may allow plug 75 to be removed, by hand or by using a screwdriver or other tool, when disassembling the structure.

In another embodiment, as illustrated in FIG. 5, blocks may be shaped to create a roof structure. Roof blocks 100 of the present invention may be shaped at an angle so that as the blocks are assembled, they create a smooth angled surface or an overlapping, shingled surface (not shown). In addition, plugs 75 designed to fit in such angled roof blocks may also be angled so that when plugs 75 are inserted into female element 25, plugs 75 are flush with the surface creating a smooth angled surface. Plugs 75 may be closed so that water or other material that might land on the roof structure cannot enter the structure through the plugs 75.

Figure 6:
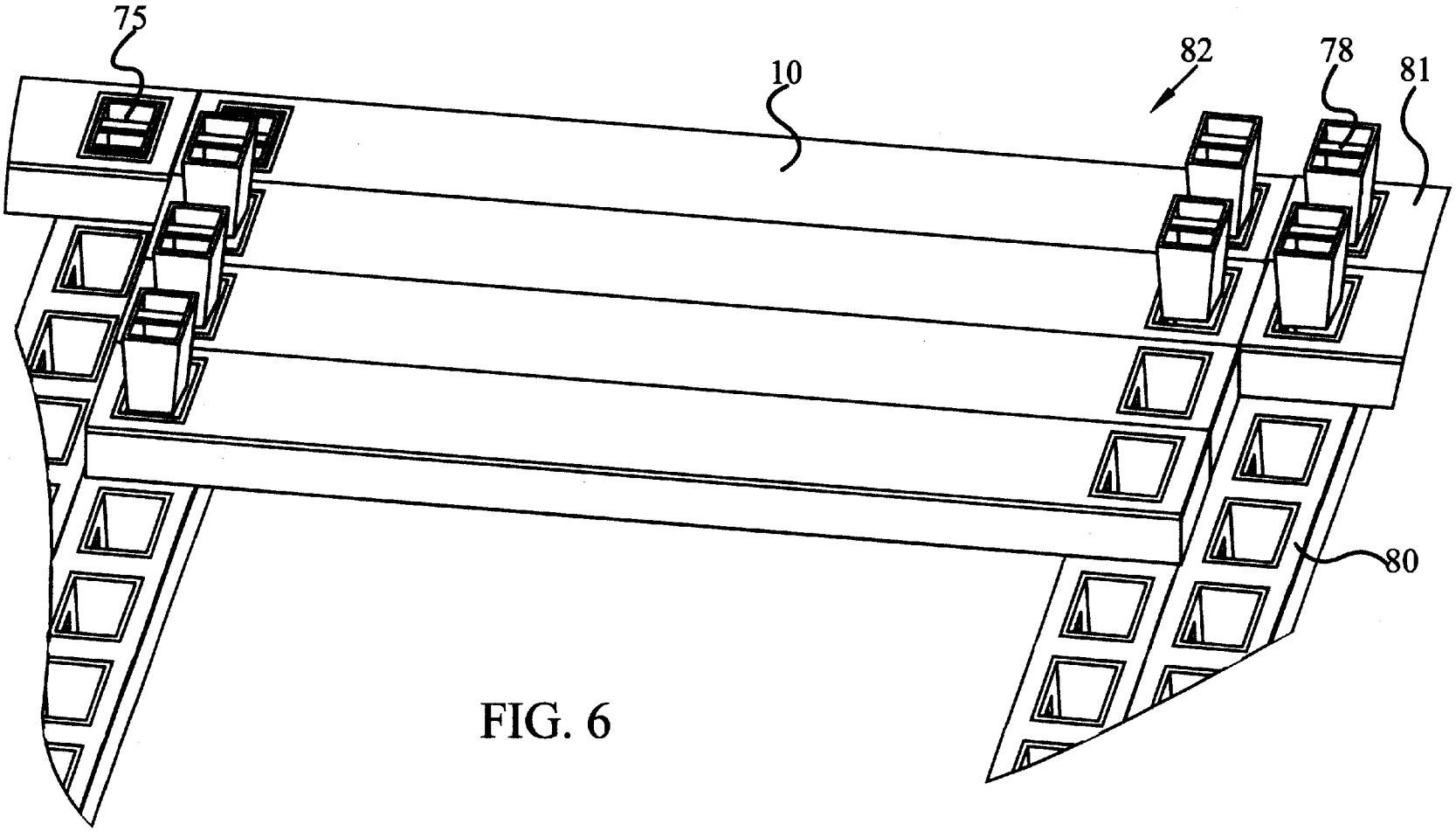
FIG. 6 depicts another embodiment of a structure built using the building blocks where the blocks are shaped to resemble boards or lumber.

FIG. 6 is another embodiment of the block 10 where the block 10 is long and rectangular and shaped like a board or piece of lumber. In this embodiment, the block 10 may be colored and pressed into a wood grain mold so that the block resembles wood. Blocks so colored and shaped may be cross-members 80 or planks 81 which can snap together to form a deck 82, as shown in FIG. 6. Plugs 75 may be used to lock the planks 81 to the cross-members 80 and to create a smooth, flush surface across the length of the deck 82. Plugs 75 may have a cross-member 78 to allow for easy removal of plugs 75 from planks 81. Deck 82 may be packaged and purchased as a kit, may be assembled without using nails, hammers, or any other tool, and may be disassembled and removed easily. In addition, the deck so assembled may be weather resistant. Rain water may flow between the planks 81 of the deck 82, and can also flow through the deck through finger holes or other openings in plug 75. These lumber-shaped blocks 10 may also be used to build fences, gazebos or other similar temporary or permanent structures.

Structures may be assembled using blocks of different shapes. For example, walls constructed as illustrated in FIG. 5 may be built as supporting structures for a deck assembled from lumber-shaped blocks 10 as shown in FIG. 6. Blocks of different shapes may be assembled to create structures with flat walls, curved walls, roof structures, deck structures, or any other shape. Blocks 10 to build these structures may be sold in kits to assemble structures with flat walls, curved walls, roof structures, deck structures, or any shape, as required or requested by the consumer.

While the invention has been particularly shown and described with reference to embodiments thereof, it will be understood by those skilled in the art that various changes in form and details may be made therein without departing from the spirit and scope of the invention.

I claim:

1. A building block system comprising:

at least three blocks, each block comprising:

at least one female element, at least one male element; and, a lock mechanism;

wherein the lock mechanism comprises a lock flange, a lock nub and a lock socket;

wherein the lock flange is structured and arranged to reversibly direct the lock nub through a lock socket of an adjacent block; and wherein when a male element of a first block is inserted into a female element of a second block, the lock nub of the first block is aligned opposite the lock socket of the second block; and wherein when a male element of a third block is inserted into a female element of the first block, the male element of the third block presses against the lock flange of the first block, forcing the lock nub of the first block through the lock nub opening of the first block and into the lock socket of the second block, thereby reversibly locking the first block to the second block.

2. The building block system of claim 1 wherein the lock flange comprises the lock nub.

3. The building block system of claim 1 wherein the lock flange is attached to an interior surface of the male element.

4. The building block system of claim 1 wherein at least one building block has a length substantially longer than its width.

5. The building block system of claim 1 further comprising a plug that, when inserted into the female element of the third building block, has a top surface which is flush with the top surface of the third building block.

6. The building block system of claim 5 wherein the plug has finger holes to assist with removing the plug from the opening through the top surface of the building block.

7. The building block system of claim 1 wherein at least one building block has an angled top surface.

* * * * *